United States Patent [19]

Ogino et al.

[11] Patent Number: 4,947,926

[45] Date of Patent: Aug. 14, 1990

[54] INVESTMENT COMPOUND FOR USE IN PRECISION CASTING MOLD

[75] Inventors: Sekiya Ogino, Kyoto; Mikinori Nishimura, Shiga, both of Japan

[73] Assignee: Kabushiki Kaisha Morita Seisakusho, Kyoto, Japan

[21] Appl. No.: 425,514

[22] Filed: Oct. 20, 1989

Related U.S. Application Data

[63] Continuation of Ser. No. 224,531, Jul. 22, 1988, abandoned.

[30] Foreign Application Priority Data

Jul. 27, 1987 [JP] Japan ..... 62-188361

[51] Int. Cl.[5] ..... B22C 1/00

[52] U.S. Cl. ..... 164/519; 164/35

[58] Field of Search ..... 164/34, 35, 36, 349, 164/361, 517, 518, 519, 520, 529; 106/38.2, 38.3, 38.9

[56] References Cited

U.S. PATENT DOCUMENTS

| | | | |
|---|---|---|---|
| 4,216,815 | 8/1980 | Feagin | 164/361 |
| 4,316,498 | 2/1982 | Horton | 106/38.9 |
| 4,553,394 | 8/1985 | Watts | 106/38.2 |
| 4,557,316 | 12/1985 | Takayanagi et al. | 164/519 |
| 4,602,667 | 7/1986 | Moore et al. | 106/38.3 |

*Primary Examiner*—Richard K. Seidel

*Attorney, Agent, or Firm*—Koda & Androlia

[57] ABSTRACT

An investment compound for use in a precision casting mold comprises MgO powder and $Al_2O_3$ powder as main constituents in such a manner that the MgO powder and/or the $Al_2O_3$ powder are or is in the range of 100 μm or less in grain size and of 10% or more in weight precent, whereby even when a high-temperature active casting material such as titanium is used, the material provides a casting having a very beautiful surface with no bubbles formed therein and can positively compensate for shrinkage due to the solidification of cast material in a lost-wax process and can advantageously provide the casting at lower prices.

1 Claim, 1 Drawing Sheet

INVESTMENT COMPOUND FOR USE IN PRECISION CASTING MOLD

This is a continuation of application Ser. No. 224,531, filed July 22, 1988 now abandoned.

BACKGROUND OF THE INVENTION

1. Field of the Invention

This invention relates to an investment compound for use in a precision casting mold adapted to metals and alloys thereof such as titanium, nickel, cobalt, chromium and glass ceramics, which are relatively high in melting temperature.

2. Prior Art

Investment compounds composed, in main constituent, of quartz, cristobalite, gypsum or the like conventionally used in casting dental prostheses tend to decompose themselves or burn together with cast metal at high temperatures and particularly react heavily with active metal such as titanium at high temperatures to greatly deteriorate the cast metal. In an effort to remove such drawbacks of the investment compounds, (1) there has been developed an investment compound of an oxidation-expansion type in which magnesium oxide or zirconia is used as a main constituent and metallic zirconium is added to the main constituent for compensating the shrinkage due to solidification of the cast metal. The present inventors also proposed in Japanese Patent Application No. 213459/1986, (2) an investment compound in which magnesium oxide and aluminum oxide are used as main constituents and fine metallic titanium powder is added to aggregate so as to make it possible to reduce the amount of shrinkage of the compound and to compensate the dimensional error caused by the shrinkage due to the solidification of the cast metal.

But the above new investment compound was not free from the following drawbacks either. Namely, as proposed in the above first case, the investment compound intended to compensate for the shrinkage due to the solidification of the cast metal by the oxidation-expansion of metallic zirconium had recourses to a very cumbersome process in which, because zirconium is very expensive, a wax pattern is coated on its surface with the investment compound and then the coated wax pattern is embedded in the conventional investment compound in an attempt to make the required amount of zirconium as small as possible. Moreover, this coated layer is liable to come off when the compound is placed between the coated layer and the pattern, with the result that titanium reacts with the externally placed compound. Furthermore, when an artificial dental plate is cast, the complexity of the shape of the plate makes it fatally impossible to employ the coating method.

On the other hand, the investment compound in the above second case is less expensive than that in the first case and is greatly improved, but because the compound includes a high percentage of metallic titanium, the reaction made by the titanium with the alkaline solution produced by the reaction of magnesium oxide with water when a wax pattern is embedded generates gas which thereby produces bubbles in the mold to make the surface of castings liable to be irregular. Titanium is much cheaper than zirconium, but more expensive than ceramics for use in casting. In this sense, titanium leaves little to be desired in point of cost. Moreover, in order to provide the added titanium with sufficient expansion effect, the metallic titanium must be oxidized and must be maintained at high temperatures in that degree for a prolonged period of time, resulting in lack of convenience and economy.

SUMMARY OF THE INVENTION

This invention has been worked out after laborious study efforts made in view of the circumstances above and is intended to provide a novel investment compound for use in precision casting molds which, in spite of the use of high-temperature active cast material such as titanium, can overcome the above disadvantages and enables suitable casting and causes expansion capable of fully compensating for the shrinkage due to solidification of the cast material in a lost-wax process and which can be supplied to users at lower prices than ever before.

DETAILED DESCRIPTION OF THE INVENTION

Figure 1:
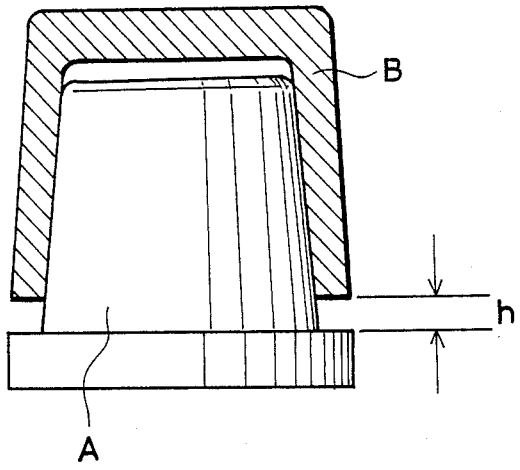
FIG. 1 is a vertical sectional view explaining how to make a fitness test of the investment compound of the invention.

Generally speaking, the investment compound for precision casting mold of the invention is based on the finding that an investment compound comprising as main constituents magnesium oxide and aluminum oxide one or both of which is or are in specific in grain size ranges and in weight percent range makes it possible to effect necessary expansion of the mold even if metallic zirconium and metallic titanium are not included and also on the finding that the mere composition of conventional magnesium oxide and aluminum oxide so far used cannot provide desired expansion. Stated more particularly, the investment compound according to the invention comprises, MgO powder and/or $Al_2O_3$ powder as main constituents in such a manner that the $M_gO$ powder and/or the $Al_2O_3$ are or is in the range of 100 μm or less in grain size and of 10% or more in weight percent, whereby the adjustment of expansion of the precision casting mold composed of the mold compound may be effected by altering the amount of MgO powder and/or $Al_2O_3$ powder in the range of 100 μm or less to thereby compensate for the dimensional error made by shrinkage due to the solidification of cast material.

In the above compound, if the content does not exceed 10% by weight, the expansion to be later described becomes unable to compensate for shrinkage due to the solidification of the cast material. It is also within the scope of the invention that the whole amount of the above powder is 100 μm or less in grain size. A degree of expansion can be changed by suitably adjusting the amount of powder less than 100 μm inclusive in grain size within the range of 10 to 100% by weight. Such shrinkage due to the solidification can suitably be compensated in response to property inherent in the cast material to be used, namely in response to the degree of shrinkage due to the solidification of the material.

The investment compound according to the invention includes any one or plural kinds of binder selected from a group consisting of magnesium acetate, zirconia cement, magnesia cement, colloidal silica, ethyl silicate and the like, in addition to the aforementioned main constituents. Incidentally, phosphate-based binders are not fit for use because they generate gas during casting.

A description follows, by way of example, of how to cast by the use of the investment compound according to the invention. First, the investment compound is kneaded with water and a casting ring around a conical base having a wax pattern formed thereon is filled with the investment compound and the wax pattern is embedded in the compound. Thereafter, the compound is heated at about 70° C. (but there may be cases wherein the compound is not heated) and is dried to hardening. At this time, since the powder contained is within 100 μm or less in grain size, it tends to react readily with water, partly reacting as expressed by the formula $$MgO+H_2O \rightarrow Mg(OH)_2$$

and/or $$Al_2O_3+H_2O \rightarrow 2Al(OH)_3$$

to produce magnesium hydroxide and/or aluminum hydroxide, whereby the investment compound expands.

The casting mold expanded and hardened in this manner is heated and fired in a firing furnace at temperatures of 850° to 900° C. to effect a lost-wax process and fire the investment compound. In this firing step, the investment compound is fired in a newly expanded state in addition to the above expansion, and the cavity formed by the lost-wax process becomes slightly larger in size than the initial wax pattern. This is supposed to be due to the fact that, because the magnesium oxide powder and aluminum oxide powder contain highly reactive fine magnesium oxide powder and/or aluminum oxide powder 100 μm or less in grain size, the powder partly changes into a so-called spinel compound by the reaction expressed by the formula:

$$MgO+Al_2O_3 \rightarrow MgO.Al_2O_3$$

according as firing proceeds, or changes into a phase leading to the spinel crystal phase to thereby expand the constituent powder substantially.

The casting mold thus formed is placed in an arc melting and differential pressure applied casting apparatus, and a molten casting material as of metals and alloys thereof such as titanium, nickel, cobalt, chromium and glass, ceramics which are relatively high in melting temperature, is poured into the lost-wax cavity to carry out casting. At this time, since the cavity has become larger than the initial wax pattern by expansion, the casting material, even if shrunk by cooling, can be brought into approximate agreement with the size of the original wax pattern by beforehand bringing the degree of expansion of the cavity into agreement with the degree of shrinkage due to solidification inherent in the cast material by suitably adjusting the compounding amount of the powder.

EXAMPLE

Investment compounds of various compounding ingredients shown in Table 1 were prepared. The wax pattern formed by impression taken from a model tooth A reproduced from a natural tooth to be repaired was embedded in the investment compound and was fired to effect a lost-wax process. Thereafter, metallic titanium was cast in an arc melting and differential pressure applied casting apparatus. The titanium cast crown B thus formed was fitted over the model tooth A to calculate the amount of clearance h between the top of the model tooth A and the crown B fitted thereover. The result is shown in Table 2.

TABLE 1

| Material | Magnesium oxide | | Aluminum oxide | | (% by weight) | |
|---|---|---|---|---|---|---|
| Example No. | *1 | *2 | *1 | *2 | Binder | Total |
| Example 1: | 40 | 27 | — | 30 | 3 | 100 |
| Example 2: | 20 | 37 | — | 40 | 3 | 100 |
| Example 3: | — | 27 | 10 | 30 | 3 | 100 |
| Example 4: | 20 | 27 | 20 | 30 | 3 | 100 |
| Example 5: | 70 | — | — | 27 | 3 | 100 |
| Example 6: | — | 27 | 70 | — | 3 | 100 |
| Contrast 1 | 5 | 62 | — | 30 | 3 | 100 |
| Contrast 2 | — | 62 | 5 | 30 | 3 | 100 |

In the table above, the numeral * 1 designates a grain size of 100 μm or less, and * 2 designates a grain size exceeding 100 μm. Magnesium acetate was used as a binder.

TABLE 2

| No. | h (mm) | No | h (mm) |
|---|---|---|---|
| Example 1 | 0–0.0 | Example 5: | 0 (over-expansion) |
| Example 2 | 0.05–0.08 | Example 6: | 0 (over-expansion) |
| Example 3 | 0.05–0.1 | Contrast 1 | 0.3–0.5 |
| Example 4 | 0.02–0.04 | Contrast 2: | 0.3–0.5 |

Time for firing the investment compound together with the wax pattern embedded therein was 60 minutes, and the temperature of the mold in time of casting was 150°. The value of clearance h designates the result of several experimental tests. The "over-expansion" designates the state in which the cast crown B is loosely fitted over the model tooth A with ample clearance between the two. When the casting material is titanium, the casting mold expands excessively, and accordingly this casting material means lack of aptitude.

All the titanium cast crowns thus obtained were very beautiful with metallic luster. It is to be understood from Table 2 that when the investment compound contains 20 to 40% by weight of fine magnesium oxide or aluminum oxide powder 100 μm or less in grain size, the titanium cast crown B increases its excellency in aptitude for the model tooth A. The clearance h varies with the amount of powder of 100 μm or less, so that, as in Examples 5 and 6, even if it is over-expansive with respect to titanium, the investment compound is supposed to have an aptitude for cast materials larger in expansion and shrinkage than titanium and alloys thereof like nickel, cobalt, chromium and other metals. Accordingly, the compound is allowed to have an aptitude for each casting by adjusting the amount of the powder in accordance with the property of a material to be used for the casting. The investment compound contains no metal powder, and accordingly 60 minutes is sufficient for firing. Thus, reduction in time attains economy. Incidentally, metallic titanium powder was added to contrast examples 1 and 2 and the same test was conducted, to find that after firing for 120 minutes, the clearance h finally reached 0.03–0.15 μmm.

As shown in the examples, when metallic titanium is cast, magnesium oxide reacts with the titanium at a temperature higher than the melting temperature of titanium, and aluminum oxide reacts with titanium even in the range of temperatures lower than the melting temperature of titanium to provide possibility of producing $Al_2O$ and AlO, but these reaction products adhere only to the surface of a titanium cast crown, so that they can be readily removed by merely being wiped off. Accordingly, a beautiful surface having metallic luster can be obtained. Magnesium acetate is used as a binder, but this is decomposed into MgO, $CO_2$, $H_2O$ during firing, and MgO alone is left after the firing and has no possibility of staining titanium, and hence no problem in practical use.

As described above, the investment compound of the invention for use in a casting mold comprises magnesium oxide powder and aluminum oxide powder in the form of main constituents and contains both or one of the powders in the range of 10% by weight or more of the powders of 100 μm or less in grain size. Accordingly, hydroxides are liable to be formed by the reaction activity of the powders when the casting mold is dried and hardened, and moreover when the investment is fired to form the casting mold, crystal transformation of the powders to a spinel followed by expansion is caused by the reaction activity of the powders, with the result that the crystal transformation suitably compensates for shrinkage due to the solidification of cast material, and greatly improves accuracy of fitness relative to a duplicated model or the like in prosthetic procedure for dental treatment. Moreover, the material used as the main constituents is generally cheap, so that the use of the material makes it possible to supply dental patients at a low price with a casting made of titanium or titanium alloy excellent in compatibility with a living body and of other previously described materials to be used for castings. Moreover, since the investment compound of the invention contains no metal powder, there is no necessity of maintaining the compound at high temperatures for a prolonged period of time, so that reduction in casting time is possible. Thus, the invention that has pronounced effects is very great in practical use.

We claim:

1. A method of precision casting titanium or titanium alloy comprising the steps of:

mixing a binder with at least one of $M_gO$ powder and $Al_2O_3$ powder to form an investment compound, said at least one of $M_gO$ and $Al_2O_3$ powder having a grain size of 100 μm or less and being 20–40% by weight of the investment compound;

kneading the investment compound with water;

embedding a wax pattern in the investment compound;

allowing said water to react with said investment compound to expand said investment compound; and firing the investment compound with the wax pattern embedded therein to effect a lost-wax process an d expand a mold thus formed;

whereby expansion of said mold compensates for dimensional errors caused by shrinkage of the titanium or titanium alloy.

* * * * *